United States Patent [19]

Rolando et al.

[11] Patent Number: 4,604,679

[45] Date of Patent: Aug. 5, 1986

[54] METHOD OF ASSEMBLING A MOTOR VEHICLE HEADLIGHT, AND HEADLIGHT PRODUCED USING SUCH A METHOD

[75] Inventors: Giovanni Rolando; Giorgio Manunta, both of Turin, Italy

[73] Assignee: Carello Industriale, S.p.A., Turin, Italy

[21] Appl. No.: 708,819

[22] Filed: Mar. 6, 1985

[30] Foreign Application Priority Data

Mar. 13, 1984 [IT] Italy ..... 67237 A/84

[51] Int. Cl.[4] ..... F21V 21/29

[52] U.S. Cl. ..... 362/277; 362/61; 362/267; 362/282; 362/296; 362/306; 362/310; 362/348

[58] Field of Search ..... 123/61, 80, 277, 267, 123/282, 284, 296, 306, 310, 319, 322, 324, 341, 347, 348

[56] References Cited

U.S. PATENT DOCUMENTS

| | | | |
|---|---|---|---|
| 2,433,982 | 1/1948 | Clarkson, Jr. et al. | 362/277 |
| 3,784,807 | 1/1974 | Boekkooi et al. | 362/267 |
| 4,344,118 | 8/1982 | Rundquist | 362/267 |
| 4,386,824 | 6/1983 | Draper | 362/347 |
| 4,390,931 | 6/1983 | Gorick et al. | 362/267 |
| 4,494,176 | 1/1985 | Sands et al. | 362/347 |
| 4,504,889 | 4/1985 | Goldfarb | 362/347 |
| 4,509,106 | 4/1985 | Mayer et al. | 362/306 |

FOREIGN PATENT DOCUMENTS

| | | | |
|---|---|---|---|
| 2524162 | 12/1976 | Fed. Rep. of Germany | 362/267 |

*Primary Examiner*—E. Rollins Cross

*Attorney, Agent, or Firm*—Morgan, Finnegan, Pine, Foley & Lee

[57] ABSTRACT

Method of assembling a motor vehicle headlight whereby the open end of a rear parabola reflector on the said headlight is fitted round with a flange having a front annular groove designed to receive a rear edge on the front glass, the position of which in relation to the optical axis on the said reflector is adjusted, prior to bonding by pouring adhesive material into the said groove, by means of a number of supporting pins mounted axially through the said flange.

6 Claims, 3 Drawing Figures

METHOD OF ASSEMBLING A MOTOR VEHICLE HEADLIGHT, AND HEADLIGHT PRODUCED USING SUCH A METHOD

BACKGROUND OF THE INVENTION

The present invention relates to a method of assembling a motor vehicle headlight.

More particularly, the present invention relates to a method for connecting a transparent member or front glass on a headlight to a rear parabolic reflector, the method being designed to enable mutual positioning of the two members in such a manner as to produce a specific type of beam emitted by a bulb located at the focal point on the reflector.

Pertinent specifications in a number of countries demand that the beam emitted by a headlight should be of a given form and direction and that the front glass on the headlight should have reference points enabling the application of measuring instruments for immediate control of correct assembly, aim and conformance of the headlight with such specifications.

In the U.S.A., for example, it is compulsory for the front glass on the headlight to have three bosses defining an outer surface at a precise angle (shown on the glass and measured by placing an instrument on the bosses) in relation to the optical axis on the reflector, so as to produce a beam conforming with U.S.A. specifications. Consequently, the front glass must be positioned in relation to the rear reflector in such a manner as to obtain a headlight conforming with specific legal requirements.

SUMMARY OF THE INVENTION

The aim of the present invention is to provide a method for assembling a headlight enabling simple, low-cost control and adjustment of the mutual connecting position of the front glass and rear reflector on a motor vehicle headlight.

With this aim in view, the present invention relates to a method for assembling a motor vehicle headlight, the latter having a transparent front member and a rear parabolic reflector, the method being characterised by the fact that it comprises stages or steps of:

inserting a rear peripheral annular edge on the transparent front member into an axial front annular groove on the reflector;

adjusting the position of a number of pins disposed on the reflector and extending through a bottom surface of the groove essentially parallel with the optical axis of the reflector, in such manner as to define a given supporting surface for the near edge of the transparent front member; and feeding bonding and sealing material into the groove for locking the rear edge of the transparent front member inside the groove and in contact with the ends of the pins.

The present invention also relates to a headlight produced using the aforementioned method.

The present invention, therefore, relates to a motor vehicle headlight comprising a transparent front member, having a rear peripheral annular edge, and a rear parabola reflector connected in watertight manner to the rear edge, characterised by the fact that the reflector presents an axial front annular groove which houses the rear edge and bonding and sealing material; the reflector comprising a number of adjustable pins extending through a bottom surface on the groove essentially parallel with the optical axis on the reflector and defining a given supporting surface for the rear edge.

BRIEF DESCRIPTION OF THE DRAWINGS

A non-limiting arrangement of the present invention will now be described with reference to the attached drawings in which.

DETAILED DESCRIPTION OF THE INVENTION

Figure 1:
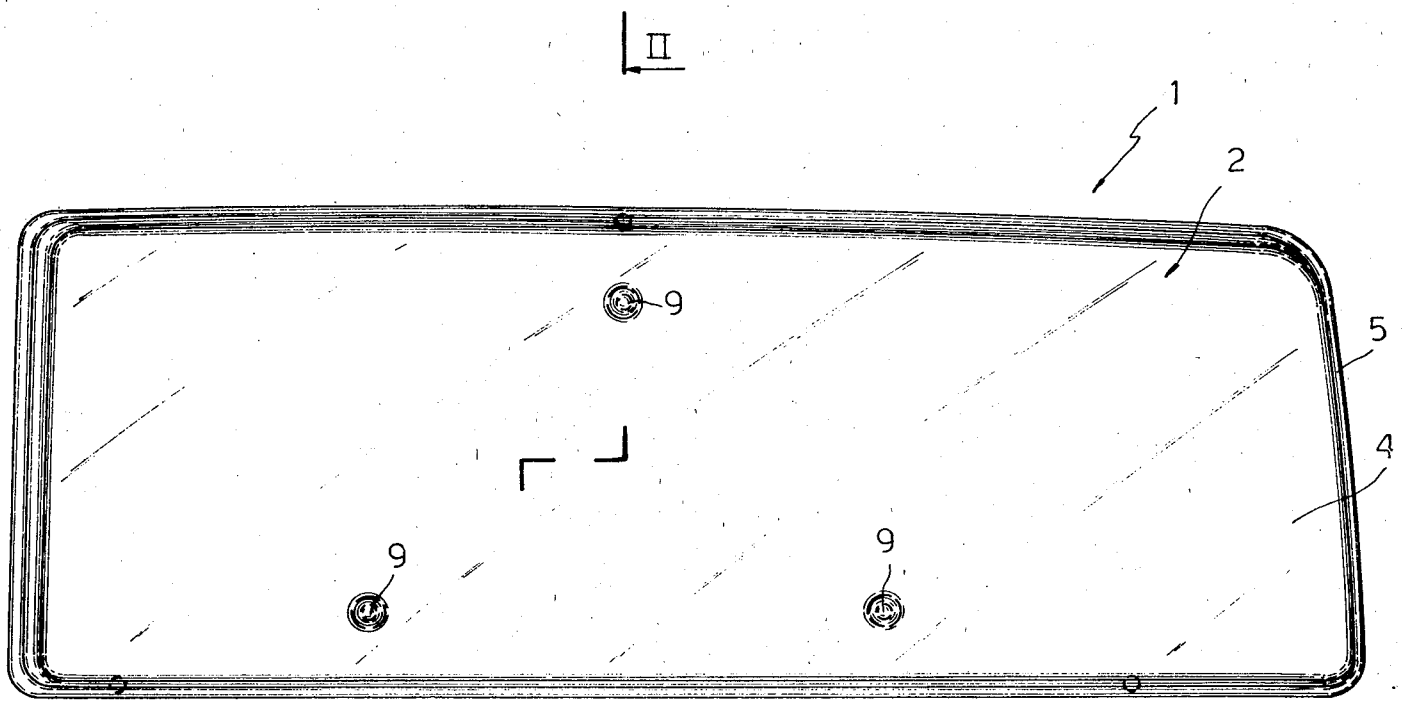
FIG. 1 shows a front elevation of a headlight according to the present invention.

The aforementioned drawings show a motor vehicle headlight 1 comprising a transparent front member 2 made of glass or synthetic material, and a rear parabola reflector 3, both connected integrally with each other in a watertight manner.

Transparent front member 2 is essentially cup-shaped and comprises a front wall 4 from the periphery of which extends a side wall 5.

Figure 3:
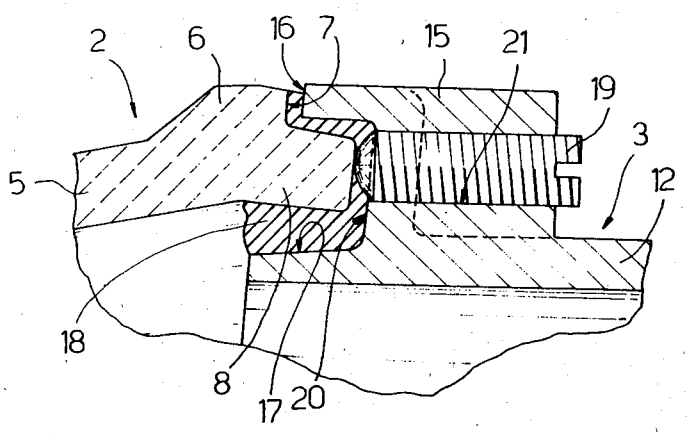
FIG. 3 shows an enlarged view of a portion of FIG. 1.

As shown particularly in FIG. 3, side wall 5 includes, at its free end, a radial annular flange 6 extending from the rear surface 7 thereof, and from which these extend axially a rib or rear annular edge 8.

Three bosses 9 project forward, from the front surface of wall 4. The bosses are arranged in the form of a triangle and the free ends thereof define a surface 10 (FIG. 2) at a given angle A in relation to optical axis 11 on reflector 3.

Figure 2:
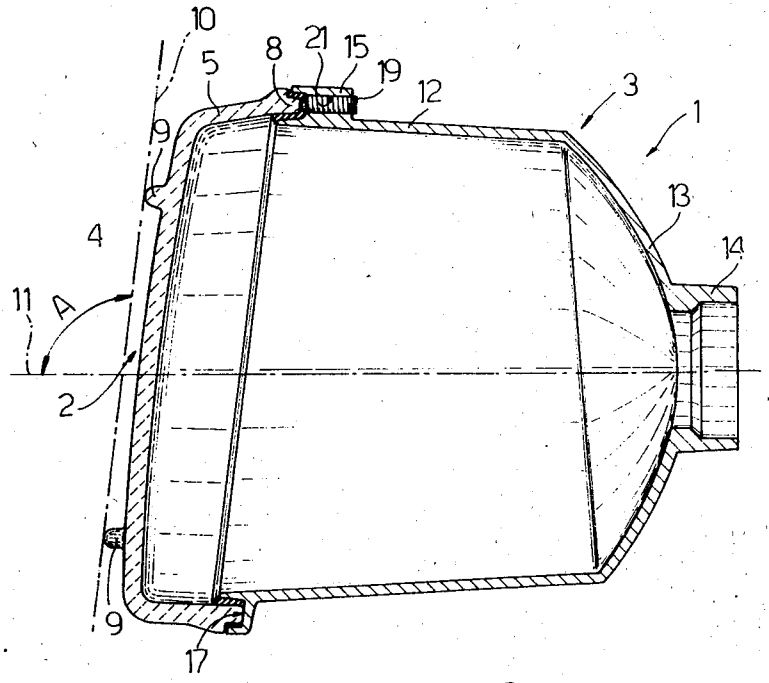
FIG. 2 shows a section of FIG. 1 along line II—II.

As shown in FIG. 2, reflector 3 comprises a front side wall 12 extending from the front periphery of a reflecting parabola 13, the axis of which coincides with optical axis 11. At the rear, parabola 13 presents an axial tubular appendix 14 designed to enable assembly of a bulb (not shown). Front side wall 12 is provided, on its free front end, with an outer annular flange 15 on the front surface 16 of which is formed an annular groove 17 which forms a seat for the annular edge 8 of transparent member 2.

Annular edge 8 of transparent member 2 is locked in groove 17 by injecting bonding and sealing material 18 with the groove and between surfaces 7 and 16 on flanges 6 and 15, thus securing an annular edge 8 in groove 17 and, as well, bring it into contact with a supporting surface defined by the ends of each of three pins 19 mounted through flange 15 and projecting inside groove 17 through bottom surface 20 thereof. As shown in more detail, particularly in FIG. 3, pins 19 which are three in number, as previously mentioned, and which are arranged evenly along flange 15, each are engaged in a respective threaded hole 21 formed through flange 15 essentially parallel with optical axis 11 of reflector 3 in a manner so that each can be adjusted externally. By appropriately adjusting pins 19, angle A may be set as desired prior to injecting bonding and sealing material 18 into groove 17 and between the surfaces on flanges 6 and 15.

We claim:

1. A method for assembling a motor vehicle headlight having a transparent front member provided with a rear, peripheral annular edge, and a rear parabola reflector provided with an axial front annular groove and at least three adjustable pins extending through the bottom of said groove along axes essentially parallel with the optical axis of said reflector, comprising inserting the rear, peripheral annular edge of said transparent front member into the axial front annular groove of said reflector, adjusting said adjustable pins along their axes, bringing them into contact with the rear edge of said transparent member and providing a supporting surface therefor, and feeding bonding and sealing material into said groove and into contact with the ends of said pins and locking said rear edge in said groove.

2. A method according to claim 1 wherein the parabola reflector includes an annular front outer flange with the adjustable pins extending through said flange and adjusting said pins externally.

3. A headlight according to claim 1 wherein the adjustable pins are arranged evenly along the groove of the parabola reflector.

4. A motor vehicle headlight comprising a transparent front member provided with a rear, peripheral annular edge, and a rear parabola reflector provided with an axial front annular groove, said front member and said reflector connected in a water-tight relationship to each other, the rear, peripheral annular edge of said front member being disposed in the axial front annular groove of said parabola reflector, at least three adjustable pins extending through the bottom of said groove along axes essentially parallel with the optical axis of said reflector and into contact with the rear edge of said transparent member and providing a supporting surface therefor, and bonding and sealing material disposed in said groove in contact with the ends of said pins and the rear edge of said front member and locking said rear edge in said groove.

5. A headlight according to claim 4 wherein the parabola reflector includes an annular front outer flange and axial front annular groove of said reflector extends along the annular front surface of said flange.

6. A headlight according to claim 5 wherein the annular front outer flange of the parabola reflector includes at least three threaded holes through which the adjustable pins extend.

* * * * *